US010262586B2

(12) United States Patent
Lin et al.

(10) Patent No.: US 10,262,586 B2
(45) Date of Patent: Apr. 16, 2019

(54) LIGHT-EMITTING DIODE DISPLAY WITH THRESHOLD VOLTAGE COMPENSATION

(71) Applicant: Apple Inc., Cupertino, CA (US)

(72) Inventors: Chin-Wei Lin, Cupertino, CA (US); Shih Chang Chang, Cupertino, CA (US); Vasudha Gupta, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 152 days.

(21) Appl. No.: 15/234,564

(22) Filed: Aug. 11, 2016

(65) Prior Publication Data

US 2017/0263183 A1 Sep. 14, 2017

Related U.S. Application Data

(60) Provisional application No. 62/308,122, filed on Mar. 14, 2016.

(51) Int. Cl.
*G09G 3/3258* (2016.01)
*G09G 3/3233* (2016.01)

(52) U.S. Cl.
CPC ... *G09G 3/3233* (2013.01); *G09G 2300/0861* (2013.01); *G09G 2310/0251* (2013.01); *G09G 2310/0262* (2013.01); *G09G 2320/043* (2013.01)

(58) Field of Classification Search
CPC ..... G09G 2300/0439
See application file for complete search history.

(56) References Cited

U.S. PATENT DOCUMENTS

| | | | | |
|---|---|---|---|---|
| 9,747,839 | B2 * | 8/2017 | Wang | G09G 3/3258 |
| 2007/0146247 | A1 | 6/2007 | Huang et al. | |
| 2008/0224965 | A1 * | 9/2008 | Kim | G09G 3/3233 345/76 |
| 2011/0063198 | A1 | 3/2011 | Chung et al. | |
| 2015/0049125 | A1 * | 2/2015 | Lee | G09G 3/3233 345/690 |
| 2015/0310806 | A1 | 10/2015 | Hu et al. | |
| 2016/0035276 | A1 | 2/2016 | Yin et al. | |
| 2016/0035282 | A1 | 2/2016 | Lu et al. | |
| 2016/0071464 | A1 * | 3/2016 | Park | G09G 3/3291 345/212 |
| 2017/0025062 | A1 * | 1/2017 | Wang | G09G 3/3233 |

* cited by examiner

*Primary Examiner* — Kwang-Su Yang
(74) *Attorney, Agent, or Firm* — Treyz Law Group, P.C.; G. Victor Treyz; Tianyi He

(57) ABSTRACT

A display may have an array of pixels. Display driver circuitry may supply data and control signals to the pixels. Each pixel may have seven transistors, a capacitor, and a light-emitting diode such as an organic light-emitting diode. The seven transistors may receive control signals over three control lines, may receive data over a data line, may receive a reference voltage from a reference voltage terminal, and may receive power from a pair of power supply terminals. The display driver circuitry may repeatedly operate each pixel in an initialization phase in which the drive transistor is preconditioned with on-bias stress, a data loading and threshold voltage sampling phase, and an emission phase.

23 Claims, 18 Drawing Sheets

LIGHT-EMITTING DIODE DISPLAY WITH THRESHOLD VOLTAGE COMPENSATION

This application claims the benefit of provisional patent application No. 62/308,122, filed Mar. 14, 2016, which is hereby incorporated by reference herein in its entirety.

BACKGROUND

This relates generally to displays, and, more particularly, to displays with pixels formed from light-emitting diodes.

Electronic devices often include displays. For example, cellular telephones and portable computers include displays for presenting information to users.

Displays such as organic light-emitting diode displays have arrays of pixels based on light-emitting diodes. In this type of display, each pixel includes a light-emitting diode and thin-film transistors for controlling application of a signal to the light-emitting diode to produce light. The thin-film transistors include drive transistors. Each drive transistor is coupled in series with a respective light-emitting diode and controls current flow through that light-emitting diode.

Manufacturing variations and variations in operating conditions can cause the threshold voltages of the drive transistors in the pixels to vary. Unless care is taken, pixel brightness fluctuations may give rise to undesired visible artifacts on a display.

To help reduce visible artifacts, displays sometimes employ threshold voltage compensation techniques to compensate for threshold voltage variations. In many situations, however, pixel brightness variations remain and visible artifacts are present on a display.

It would therefore be desirable to be able to provide a display with improved threshold voltage compensation circuitry.

SUMMARY

A display may have an array of pixels. Display driver circuitry may supply data and control signals to the pixels. Each pixel may have seven transistors, a capacitor, and a light-emitting diode such as an organic light-emitting diode.

The seven transistors of each pixel may receive control signals over three control lines, may receive data over a data line, may receive a reference voltage from a reference voltage terminal, and may receive power from a pair of power supply terminals. The display driver circuitry may adjust the data and control signals to repeatedly operate each pixel in an initialization phase in which the drive transistor is preconditioned with on-bias stress, a data loading and threshold voltage sampling phase, and an emission phase.

DETAILED DESCRIPTION

Figure 1:
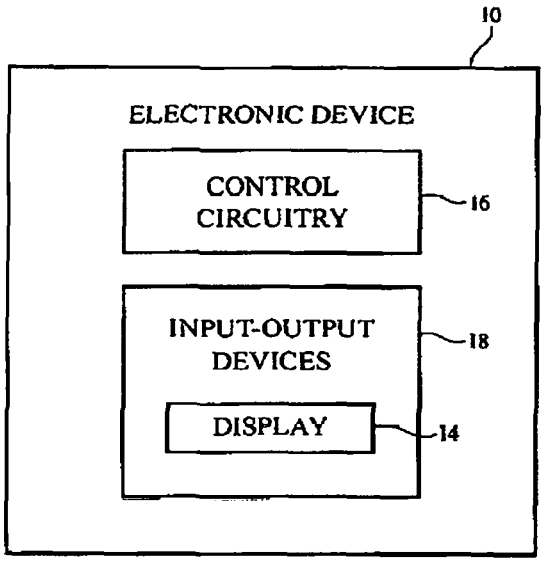
FIG. 1 is a schematic diagram of an illustrative electronic device having a display in accordance with an embodiment.

Electronic devices may be provided with displays. A schematic diagram of an illustrative electronic device with a display is shown in FIG. 1. Device 10 of FIG. 1 may be a computing device such as a laptop computer, a computer monitor containing an embedded computer, a tablet computer, a cellular telephone, a media player, or other handheld or portable electronic device, a smaller device such as a wrist-watch device (e.g., a watch with a wrist strap), a pendant device, a headphone or earpiece device, a device embedded in eyeglasses or other equipment worn on a user's head, or other wearable or miniature device, a television, a computer display that does not contain an embedded computer, a gaming device, a navigation device, an embedded system such as a system in which electronic equipment with a display is mounted in a kiosk or automobile, equipment that implements the functionality of two or more of these devices, or other electronic equipment.

As shown in FIG. 1, electronic device 10 may have control circuitry 16. Control circuitry 16 may include storage and processing circuitry for supporting the operation of device 10. The storage and processing circuitry may include storage such as hard disk drive storage, nonvolatile memory (e.g., flash memory or other electrically-programmable-read-only memory configured to form a solid state drive), volatile memory (e.g., static or dynamic random-access-memory), etc. Processing circuitry in control circuitry 16 may be used to control the operation of device 10. The processing circuitry may be based on one or more microprocessors, microcontrollers, digital signal processors, baseband processors, power management units, audio chips, application specific integrated circuits, etc.

Input-output circuitry in device 10 such as input-output devices 18 may be used to allow data to be supplied to device 10 and to allow data to be provided from device 10 to external devices. Input-output devices 18 may include buttons, joysticks, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input-output devices 18 and may receive status information and other output from device 10 using the output resources of input-output devices 18.

Input-output devices 18 may include one or more displays such as display 14. Display 14 may be a touch screen display that includes a touch sensor for gathering touch input from a user or display 14 may be insensitive to touch. A touch sensor for display 14 may be based on an array of capacitive touch sensor electrodes, acoustic touch sensor structures, resistive touch components, force-based touch sensor structures, a light-based touch sensor, or other suitable touch sensor arrangements.

Control circuitry 16 may be used to run software on device 10 such as operating system code and applications. During operation of device 10, the software running on control circuitry 16 may display images on display 14.

Display 14 may be an organic light-emitting diode display, a display formed from an array of discrete light-emitting diodes each formed from a crystalline semiconductor die, or any other suitable type of display. Configurations in which the pixels of display 14 include light-emitting diodes are sometimes described herein as an example. This is, however, merely illustrative. Any suitable type of display may be used for device 10, if desired.

Figure 2:
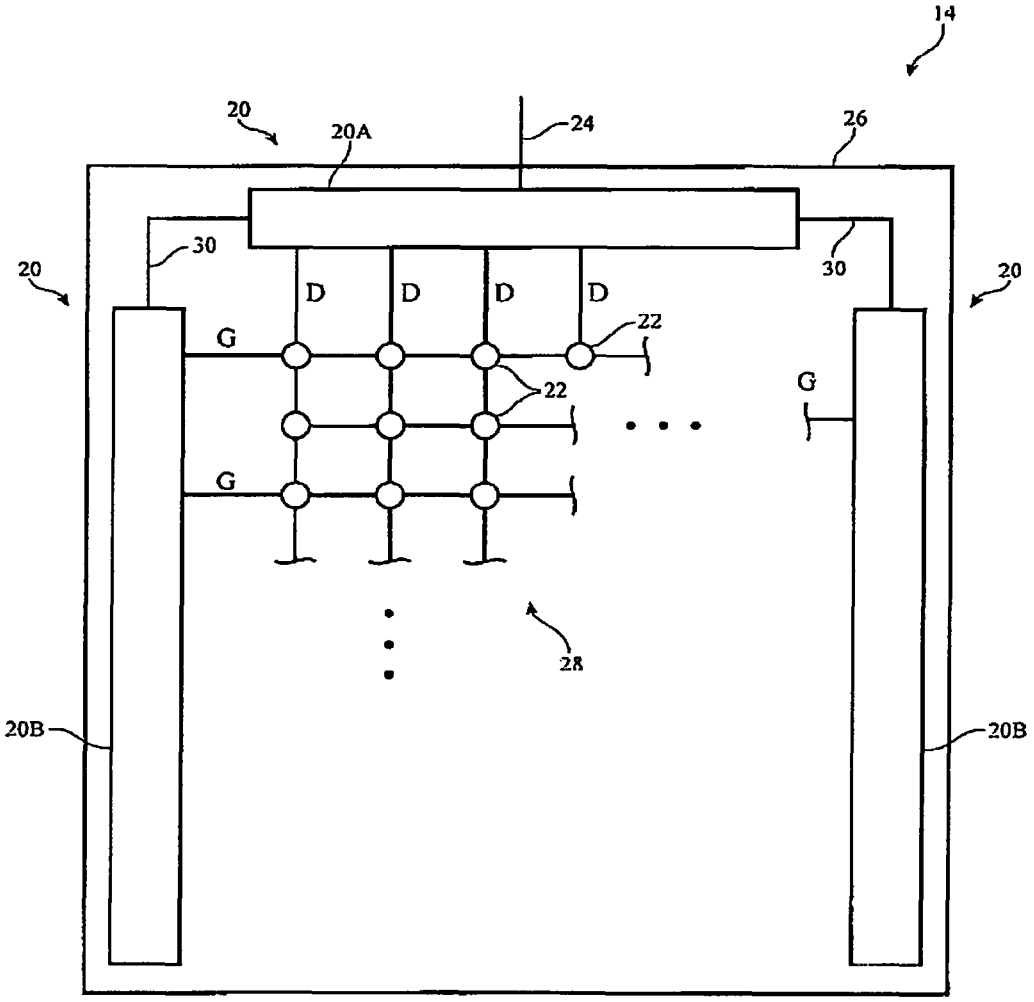
FIG. 2 is a schematic diagram of an illustrative display in accordance with an embodiment.

FIG. 2 is a diagram of an illustrative display. As shown in FIG. 2, display 14 may include layers such as substrate layer 26. Substrate layers such as layer 26 may be formed from rectangular planar layers of material or layers of material with other shapes (e.g., circular shapes or other shapes with one or more curved and/or straight edges). The substrate layers of display 14 may include glass layers, polymer layers, composite films that include polymer and inorganic materials, metallic foils, etc.

Display 14 may have an array of pixels 22 for displaying images for a user such as pixel array 28. Pixels 22 in array 28 may be arranged in rows and columns. The edges of array 28 may be straight or curved (i.e., each row of pixels 22 and/or each column of pixels 22 in array 28 may have the same length or may have a different length). There may be any suitable number of rows and columns in array 28 (e.g., ten or more, one hundred or more, or one thousand or more, etc.). Display 14 may include pixels 22 of different colors. As an example, display 14 may include red pixels, green pixels, and blue pixels. If desired, a backlight unit may provide backlight illumination for display 14.

Display driver circuitry 20 may be used to control the operation of pixels 28. Display driver circuitry 20 may be formed from integrated circuits, thin-film transistor circuits, and/or other suitable circuitry. Illustrative display driver circuitry 20 of FIG. 2 includes display driver circuitry 20A and additional display driver circuitry such as gate driver circuitry 20B. Gate driver circuitry 20B may be formed along one or more edges of display 14. For example, gate driver circuitry 20B may be arranged along the left and right sides of display 14 as shown in FIG. 2.

As shown in FIG. 2, display driver circuitry 20A (e.g., one or more display driver integrated circuits, thin-film transistor circuitry, etc.) may contain communications circuitry for communicating with system control circuitry over signal path 24. Path 24 may be formed from traces on a flexible printed circuit or other cable. The control circuitry may be located on one or more printed circuits in electronic device 10. During operation, the control circuitry (e.g., control circuitry 16 of FIG. 1) may supply circuitry such as a display driver integrated circuit in circuitry 20 with image data for images to be displayed on display 14. Display driver circuitry 20A of FIG. 2 is located at the top of display 14. This is merely illustrative. Display driver circuitry 20A may be located at both the top and bottom of display 14 or in other portions of device 10.

To display the images on pixels 22, display driver circuitry 20A may supply corresponding image data to data lines D while issuing control signals to supporting display driver circuitry such as gate driver circuitry 20B over signal paths 30. With the illustrative arrangement of FIG. 2, data lines D run vertically through display 14 and are associated with respective columns of pixels 22.

Gate driver circuitry 20B (sometimes referred to as gate line driver circuitry or horizontal control signal circuitry) may be implemented using one or more integrated circuits and/or may be implemented using thin-film transistor circuitry on substrate 26. Horizontal control lines G (sometimes referred to as gate lines, scan lines, emission control lines, etc.) run horizontally through display 14. Each gate line G is associated with a respective row of pixels 22. If desired, there may be multiple horizontal control lines such as gate lines G associated with each row of pixels. Individually controlled and/or global signal paths in display 14 may also be used to distribute other signals (e.g., power supply signals, etc.).

Gate driver circuitry 20B may assert control signals on the gate lines G in display 14. For example, gate driver circuitry 20B may receive clock signals and other control signals from circuitry 20A on paths 30 and may, in response to the received signals, assert a gate line signal on gate lines G in sequence, starting with the gate line signal G in the first row of pixels 22 in array 28. As each gate line is asserted, data from data lines D may be loaded into a corresponding row of pixels. In this way, control circuitry such as display driver circuitry 20A and 20B may provide pixels 22 with signals that direct pixels 22 to display a desired image on display 14. Each pixel 22 may have a light-emitting diode and circuitry (e.g., thin-film circuitry on substrate 26) that responds to the control and data signals from display driver circuitry 20.

Figure 3:
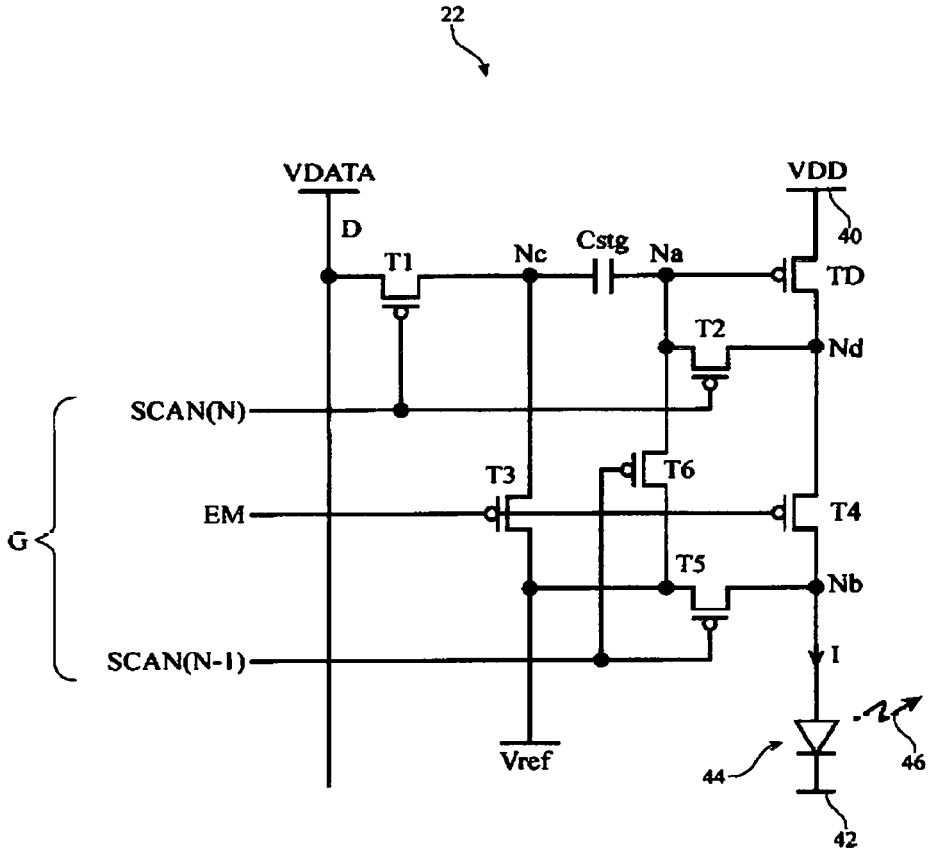
FIG. 3 is a diagram of an illustrative pixel circuit in accordance with an embodiment.

An illustrative pixel circuit of the type that may be used for each pixel 22 in array 28 is shown in FIG. 3. In the example of FIG. 3, pixel circuit 22 has seven transistors T1, T2, T3, T4, T5, T6, and TD and one capacitor Cstg, so pixel circuit 22 may sometimes be referred to as a 7T1C pixel circuit. Other numbers of transistors and capacitors may be used in pixels 22 if desired. The transistors may be p-channel transistors (as shown in FIG. 3) and/or may be n-channel transistors or other types of transistors. The active regions of thin-film transistors for pixel circuit 22 and other portions of display 14 may be formed from silicon (e.g., polysilicon channel regions), semiconducting oxides (e.g., indium gallium zinc oxide channel regions), or other suitable semiconductor thin-film layers.

As shown in FIG. 3, pixel circuit 22 includes light-emitting diode 44 (e.g., an organic light-emitting diode, a crystalline micro-light-emitting diode die, etc.). Light-emitting diode 44 may emit light 46 in proportion to the amount of current I that is driven through light-emitting diode 44 by transistor TD. Transistor TD, transistor T4, and light-emitting diode 44 may be coupled in series between respective power supply terminals (see, e.g., positive power supply terminal 40 and ground power supply terminal 42). Transistor TD may have a source terminal coupled to positive power supply terminal 40, a drain terminal coupled to node Nd, and a gate terminal coupled to node Nb. The voltage on node Nb at the gate of transistor TD controls the amount of current I that is produced by transistor TD. This current is driven through light-emitting diode 44, so transistor TD may sometimes be referred to as a drive transistor.

Transistor T4 can be turned off to interrupt current flow between transistor TD and diode 44 and may be turned on to enable current flow between transistor TD and diode 44. Emission enable control signal EM is applied to the gates of transistors T3 and T4. During operation, transistors T4 and T3 are controlled by emission enable control signal EM and are sometimes referred to as emission transistors or emission enable transistors. Control signals scan(n) and scan(n−1), which may sometimes be referred to as switching transistor control signals, are applied to the gates of switching transistors T1, T2, T5, and T6 and control the operation of transistors T1, T2, T5, and T6.

Figure 4:
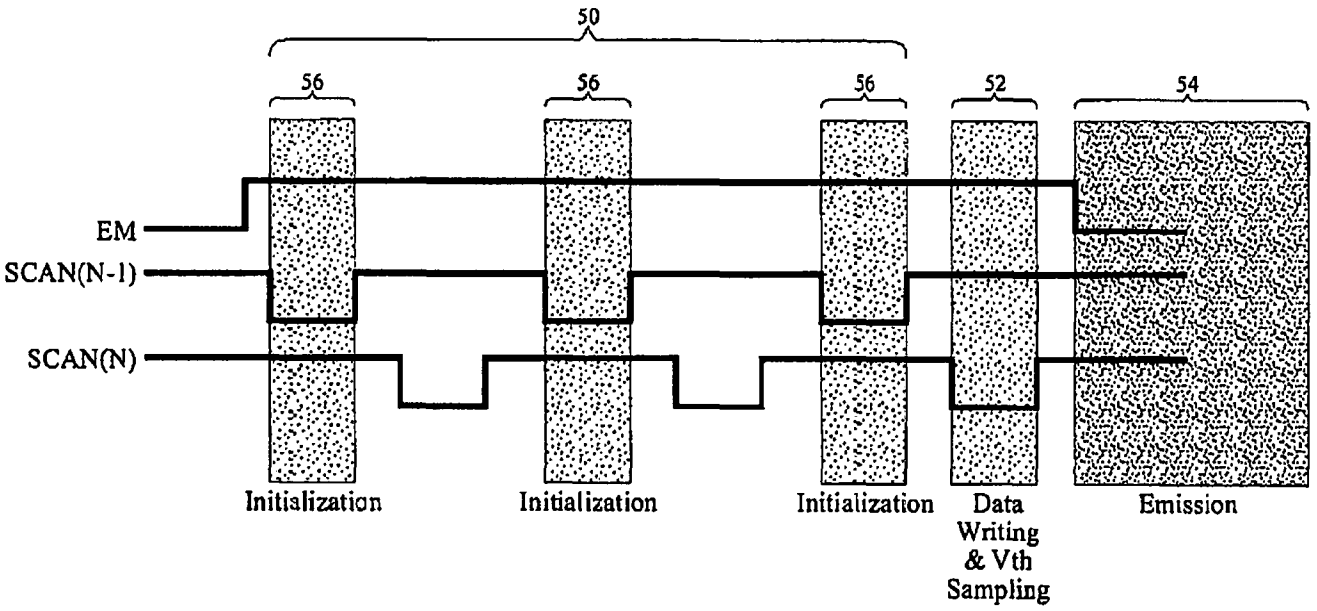
FIG. 4 is a timing diagram showing signals and operations involved in using a pixel circuit of the type shown in FIG. 3 in a display in accordance with an embodiment.

A timing diagram showing how the signals of pixel 22 of FIG. 3 may be controlled by display driver circuitry 20 is shown in FIG. 4. The signals of FIG. 4 may be applied repetitively. In particular, during the operation of display 14, each pixel 22 may be repeatedly initialized during an initialization phase 50, loaded with data during data writing and threshold voltage sampling phase 52, and used to produce light 46 in accordance with the loaded data during emission phase 54.

First, pixel 22 is initialized during initialization period 50. Initialization period 50 may include multiple on-bias stress periods such as periods 56 (e.g., periods that are each one row time 1H in duration). During initialization period 50, on-bias stress is applied to drive transistor TD to precondition drive transistor TD and thereby ensure that the threshold voltage Vth of transistor TD has stabilized and is not affected by threshold voltage hysteresis. By using multiple on-bias stress pulses (during which scan(n−1) is taken low, scan(n) is taken high, and EM is held high), a desired amount of on-bias stress is applied to drive transistor TD. In the example of FIG. 4, there are three on-bias pulses 56 per initialization period 50, but this is merely illustrative. Fewer pulses 56 may be used per period 50 (i.e., if less on-bias stress for the gate of drive transistor TD is desired) or more pulses 56 may be used per period 40 (i.e., if more on-bias stress for drive transistor TD is desired).

Second, after initialization period 50 is complete, display driver circuitry 20 may load data Vdata onto data line D in data writing and threshold voltage sampling period 52. During this period, node Nc is taken to data voltage value Vdata and node Na is taken to Vdd-Vth (i.e., the threshold voltage Vth of drive transistor TD is sampled).

Thirdly, after data Vdata has been loaded into pixel 22, display driver circuitry 20 places pixel 22 in its emission state. During the emission state, the value of Vdata controls the state of drive transistor TD and thereby controls the amount of light 46 emitted by light-emitting diode 44. Due to the threshold voltage sampling that occurs during period 52, the drive current I that drive transistor TD produces for diode 44 during period 54 is independent of the value of Vth (i.e., threshold voltage compensation has been effectively implemented).

Figure 5:
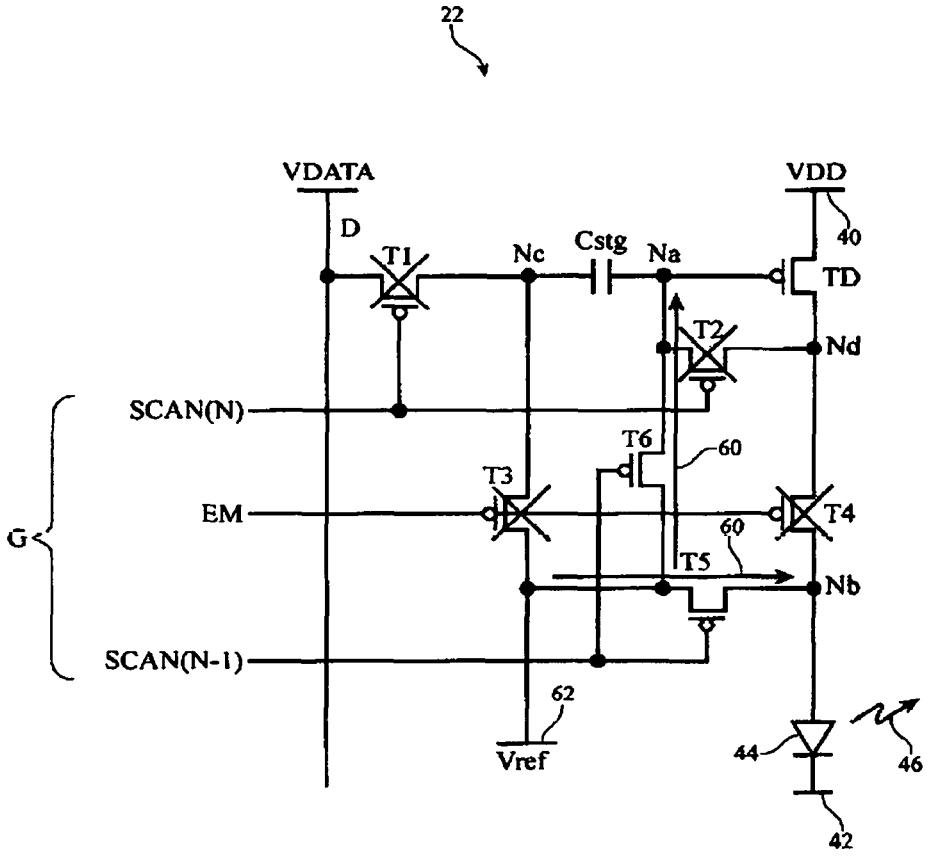
FIG. 5 is a diagram showing current flow in the pixel circuit of FIG. 3 during initialization operations in accordance with an embodiment.
Figure 6:
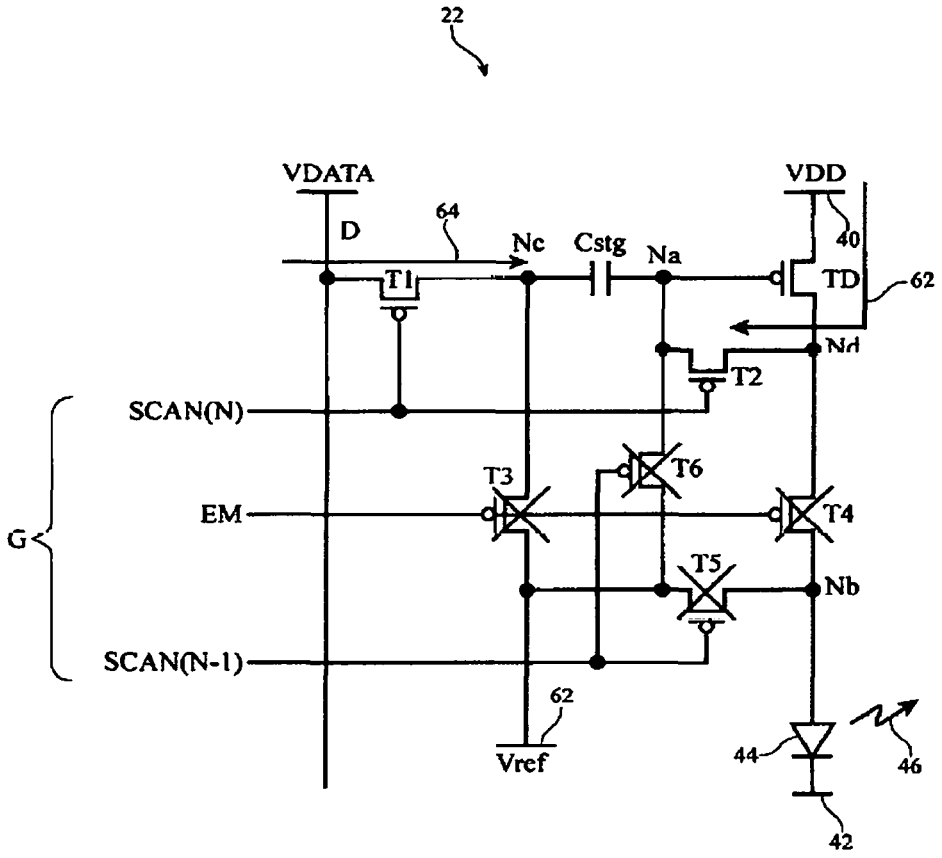
FIG. 6 is a diagram showing current flow in the pixel circuit of FIG. 3 during data writing (loading) and threshold voltage sampling operations in accordance with an embodiment.
Figure 7:
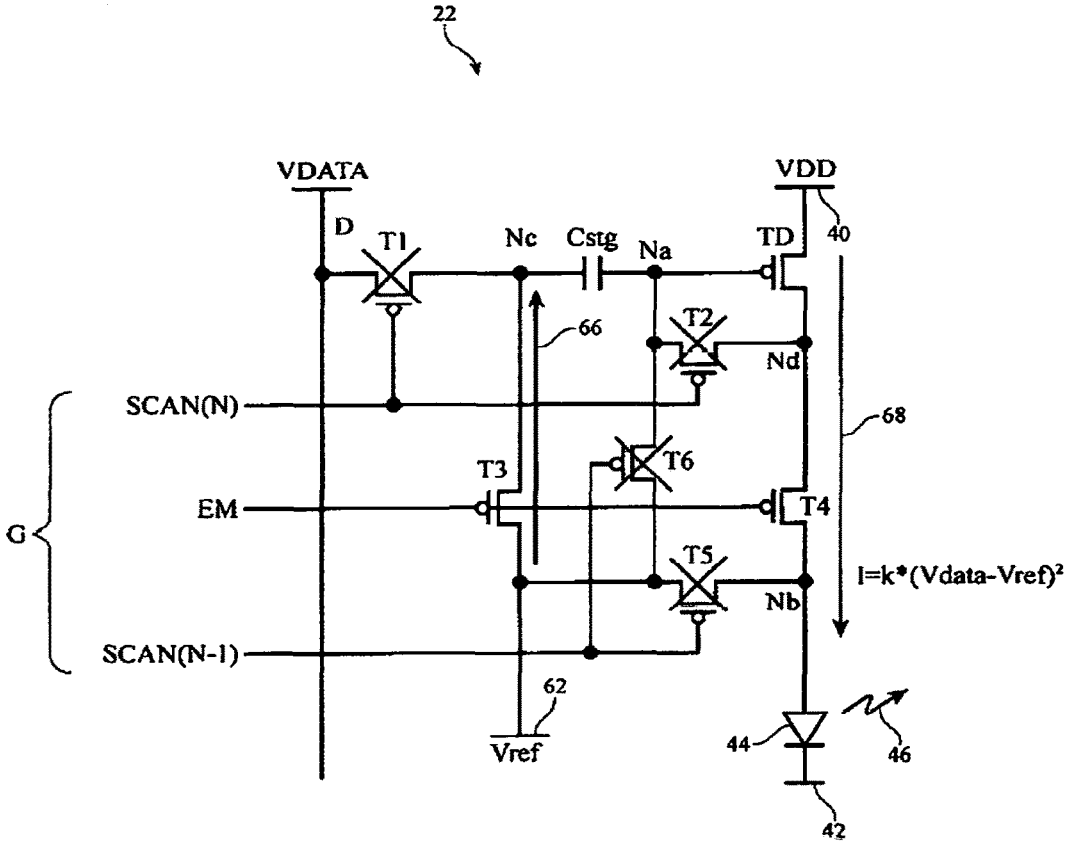
FIG. 7 is a diagram showing current flow in the pixel circuit of FIG. 3 during emission operations in accordance with an embodiment.

FIGS. 5, 6, and 7 show how pixel circuit 22 operates during periods 50, 52, and 54, respectively.

Threshold voltage Vth of transistor TD may be about 2 volts (as an example). Data signal Vdata may be about 0-5 volts. Positive power supply voltage Vdd on terminal 40 may be about 8 volts. Reference voltage Vref may be less than Vth of TD (i.e., Vref may be 1.2 volts or other value less than 2 volts in this example).

Initialization operations are illustrated in the circuit diagram of FIG. 5. As shown in FIG. 5, during periods 56 of initialization phase 50, transistors T1, T2, T3, and T4 are off and current flows towards nodes Na and Nb as indicated by arrows 60. This takes node Na to Vref and takes node Nb to Vref, thereby supplying the terminals of transistor TD with desired voltages for preconditioning.

The gate-source voltage Vgs of drive transistor TD is given by the difference between the voltage Vdd on terminal 40 at the source of transistor TD and the voltage Vref on the gate of transistor TD (i.e., the voltage on node Na). If Vdd is 8 volts and Vref is 1.2 volts, Vgs will be about 6.8 volts, which is much greater than threshold voltage Vth (about 2 volts) of transistor TD. As a result, transistor TD is subjected to a preconditioning "on" gate bias stress ("on bias"). This on bias preconditioning of transistor TD helps ensure that the performance of transistor TD during subsequent emission operations will not be overly influenced by hysteresis in the performance of transistor TD (i.e., drive-current versus Vgs hysteresis that might otherwise arise from trapped negative charge in the gate oxide of transistor TD that could lead to undesired negative shifts in the threshold voltage of transistor TD).

Advantageously, there is no current path available between positive power supply terminal 40 and reference voltage terminal (path) 62 during the initialization phase, because transistor T4 is off. As a result, power consumption during periods 56 and initialization phase 50 is low. Because power consumption is low during on-bias preconditioning of transistor TD, a relatively large amount of preconditioning (i.e., numerous pulses 56) may be applied to transistor TD. This allows the threshold voltage Vth of transistor TD to stabilize to a known desired value.

Data writing and threshold voltage sampling operations (period 52 of FIG. 4) are illustrated in FIG. 6. As shown in FIG. 6, during period 52, transistors T1 and T2 are turned on by taking scan(n) low, while the remaining transistors of pixel 22 are turned off. With transistor T2 on, current flows into node Na from positive power supply terminal 40 through transistors TD and T2 until the voltage on node Na has reached Vdd-Vth, as shown by arrow 62. Display driver circuitry 20 also loads data signal Vdata onto node Nc through data line D and transistor T1, as indicated by arrow 64.

Emission operations (emission period 54 of FIG. 4) are illustrated in FIG. 7. As shown in FIG. 7, during emission operations, transistors T3 and T4 are turned on by taking emission enable control signal EM low. Switching transistors T1, T2, T5, and T6 are turned off by taking the control signals on their gates high. Because transistor T3 is on and transistor T1 is off, the voltage on node Nc changes from Vdata to Vref due to current along path 66. Node Na is floating, so the change in voltage on node Nc is passed to node Na via capacitive coupling through capacitor Cstg. As a result, the voltage on node Na is taken to Vdd-Vth-Vdata+Vref. Current I through drive transistor TD and therefore through light-emitting diode 44 is proportional to the drive transistor's gate-source voltage minus Vth. The threshold voltage term cancels (i.e., Vgs is proportional to Vth, so Vgs-Vth is independent of Vth) and I is therefore independent of Vth. As shown by the labeled current I adjacent to arrow 68 of FIG. 7, current I is proportional only to Vdata and Vref and is not affected by variations in threshold voltage Vth. Due to the preconditioning operations during period 50, hysteresis effects due to charge trapping in the gate insulator of drive transistor TD are minimized.

Figure 8:
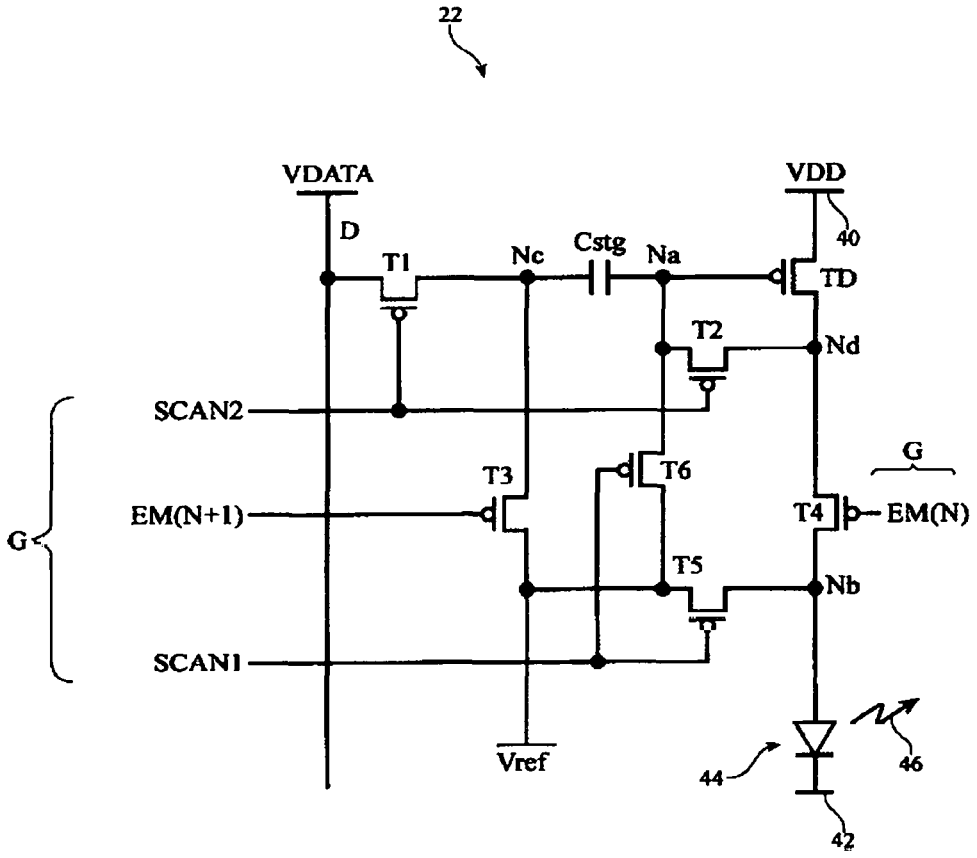
FIG. 8 is a diagram of another illustrative pixel circuit in accordance with an embodiment.

FIG. 8 is a diagram of another illustrative pixel circuit of the type that may be used in display 14. In pixel 22 of FIG. 8, display driver circuitry 20 provides pixel 22 with two separate emission enable control signals. Emission enable signal EM(n+1) is applied to the gate of transistor T3. Emission enable signal EM(n) is applied independently to the gate of transistor T4.

Figure 9:
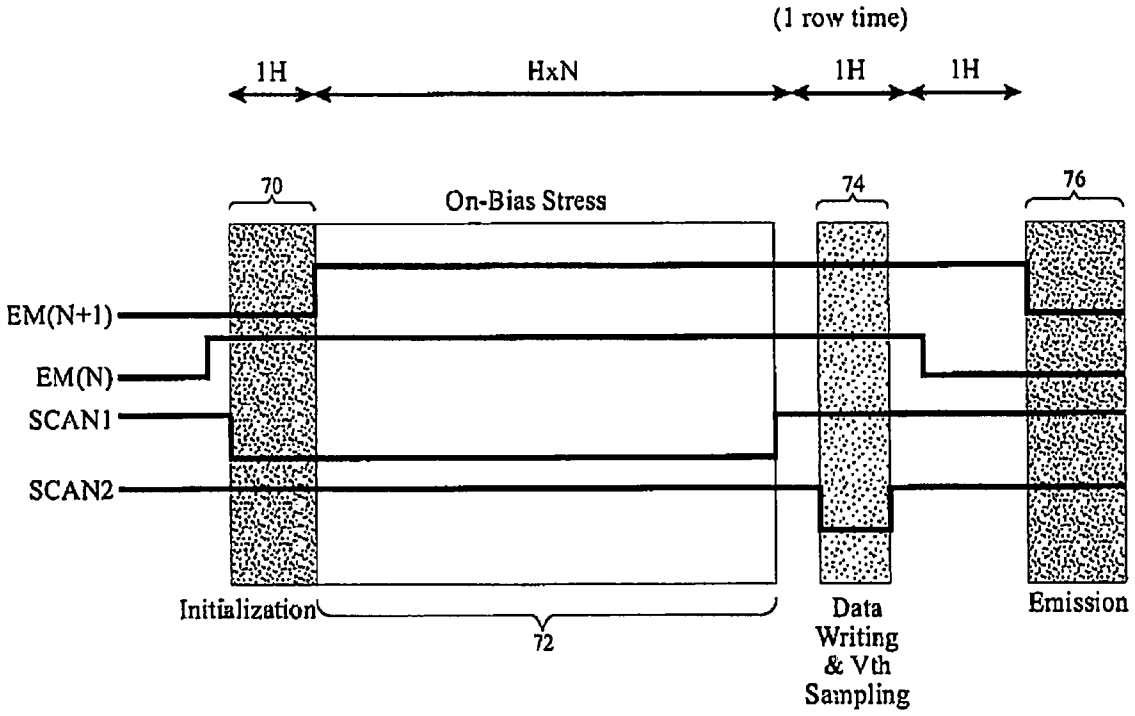
FIG. 9 is a timing diagram showing signals and operations involved in using a pixel circuit of the type shown in FIG. 8 in a display in accordance with an embodiment.

FIG. 9 is a timing diagram showing signals and operations involved in using a pixel circuit of the type shown in FIG. 8 in display 14. As shown in FIG. 9, display driver circuitry 20 operates each pixel 22 in display 14 in four repeated stages—initialization period 70, on-bias stress period 72, data writing and threshold voltage sampling period 74, and emission period 76.

Figure 10:
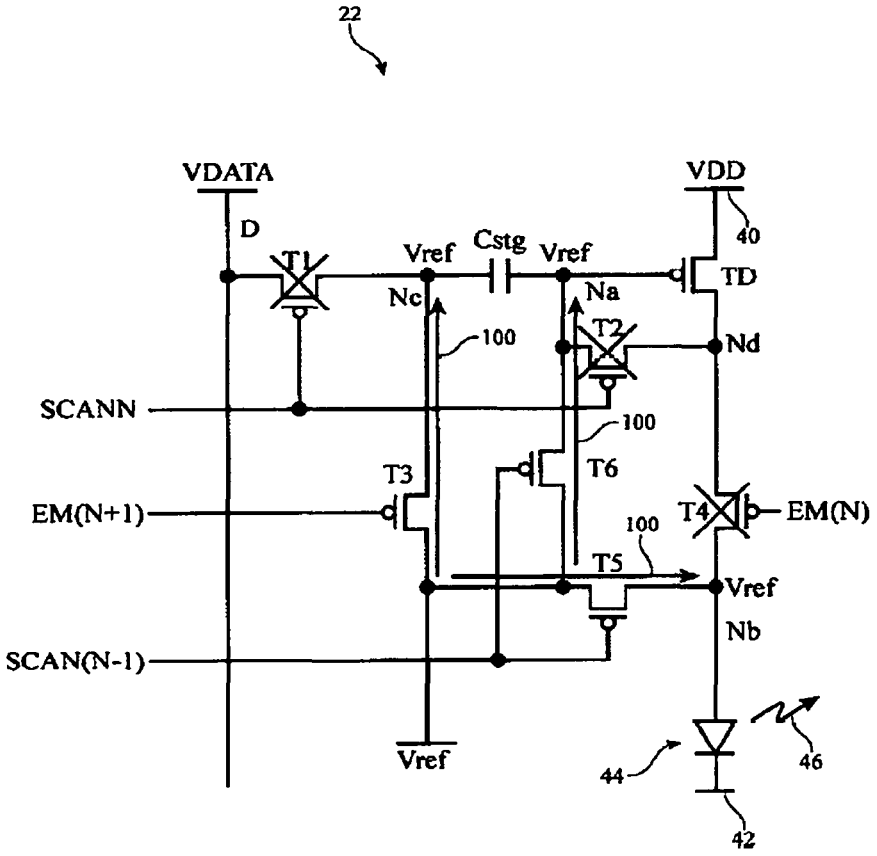
FIG. 10 is a diagram showing current flow in the pixel circuit of FIG. 8 during initialization operations in accordance with an embodiment.

Operation of pixel 22 of FIG. 8 during initialization period 70 of FIG. 9 is shown in FIG. 10. As shown by arrows 100 in FIG. 10, transistors T3, T6, and T5 are on, so voltage Vref is placed on nodes Nc, Na, and Nb.

Figure 11:
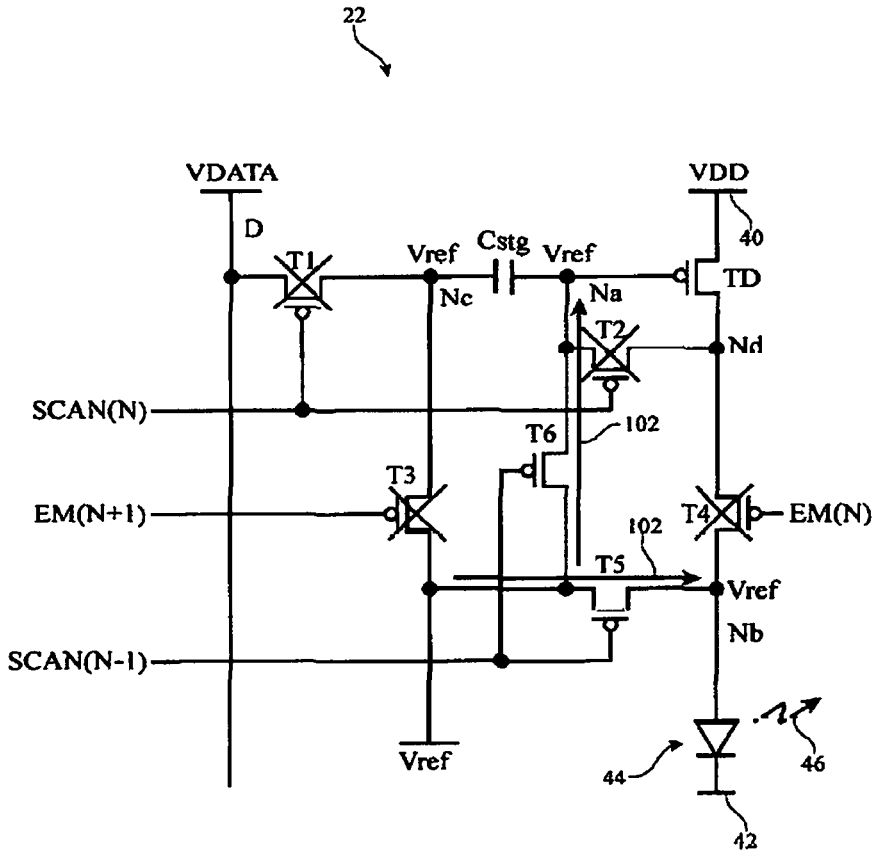
FIG. 11 is a diagram showing current flow in the pixel circuit of FIG. 8 during on-bias stress operations in accordance with an embodiment.

Operation of pixel 22 of FIG. 8 during on-bias stress period 72 of FIG. 9 is shown in FIG. 11. As shown by arrows 102 in FIG. 11, transistors T6 and T5 remain on during period 72, so voltage Vref continues to be maintained on nodes Na and Nb. There is no current flow from Vdd to Vref during initialization period 70 and on-bias stress period 72, so a relatively long on-bias stress may be used to reduce Vth hysteresis effects.

Figure 12:
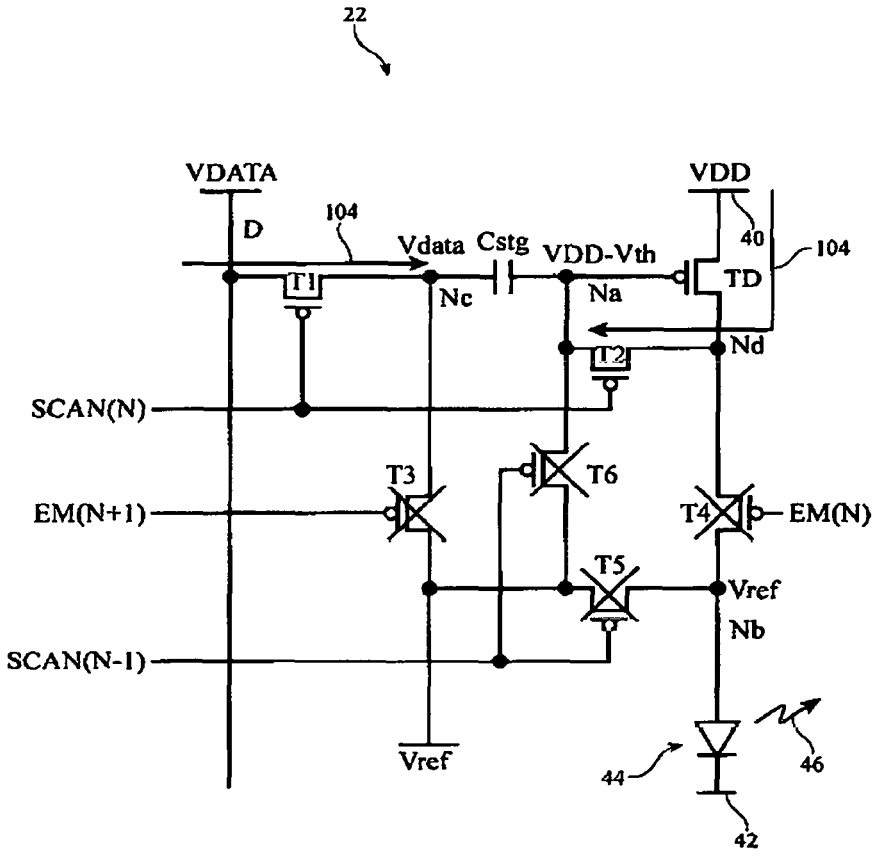
FIG. 12 is a diagram showing current flow in the pixel circuit of FIG. 8 during data writing (loading) and threshold voltage sampling operations in accordance with an embodiment.

FIG. 12 is a diagram showing current flow in pixel circuit 22 of FIG. 8 during data writing and threshold voltage sampling period 74 of FIG. 9. As shown by arrows 104, during period 74, data signal Vdata is loaded onto node Nc through transistor T1 and voltage Vdd-Vth is located onto node Na through transistor TD.

Figure 13:
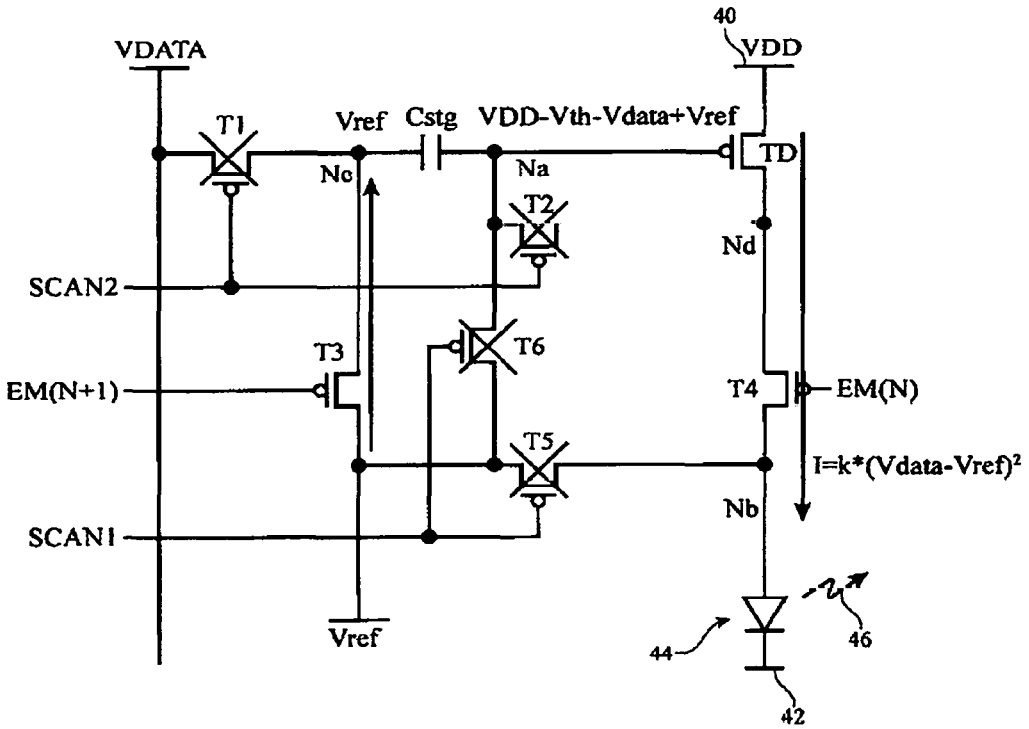
FIG. 13 is a diagram showing current flow in the pixel circuit of FIG. 8 during emission operations in accordance with an embodiment.

FIG. 13 is a diagram showing current flow in pixel circuit 22 of FIG. 8 during emission period 76 of FIG. 9. As shown in FIG. 13, current I is independent of threshold voltage Vth.

Figure 14:
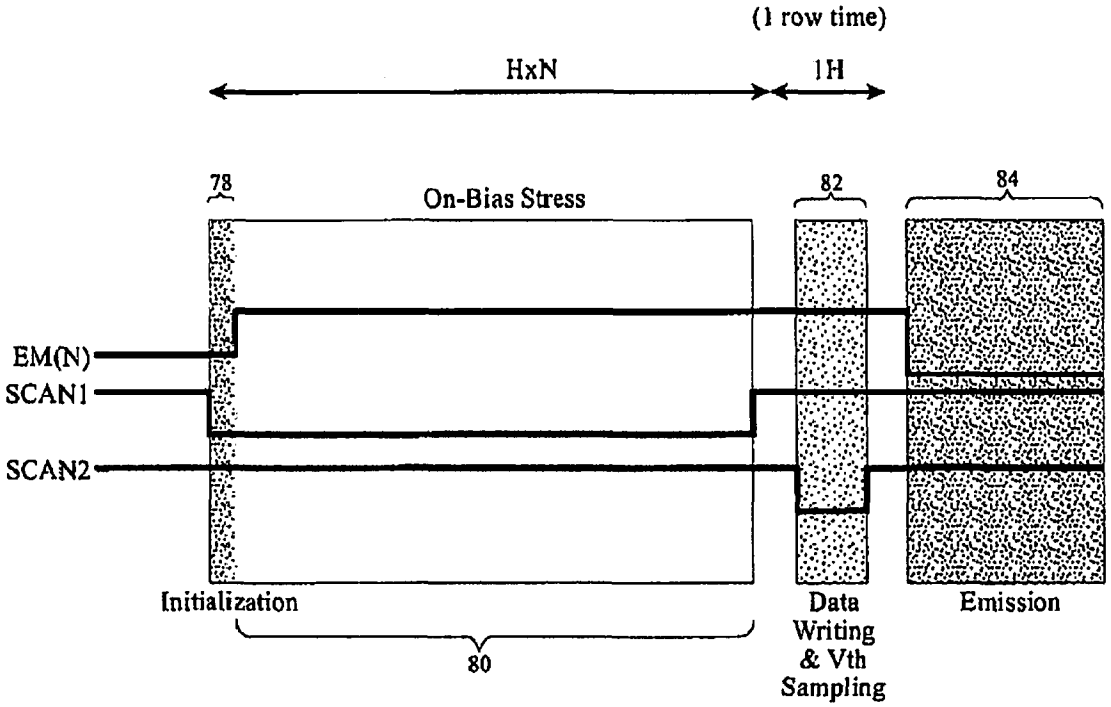
FIG. 14 is a timing diagram showing additional signals and operations of the type that may be used in operating a pixel circuit of the type shown in FIG. 3 in a display in accordance with an embodiment.

FIG. 14 is a timing diagram showing additional signals and operations of the type that may be used in operating a pixel circuit of the type shown in FIG. 3 in display 14. As shown in FIG. 14, display driver circuitry 20 may operate each pixel 22 in display 14 in four repeated stages—initialization period 78, on-bias stress period 80, data writing and threshold voltage sampling period 82, and emission period 84.

Figure 15:
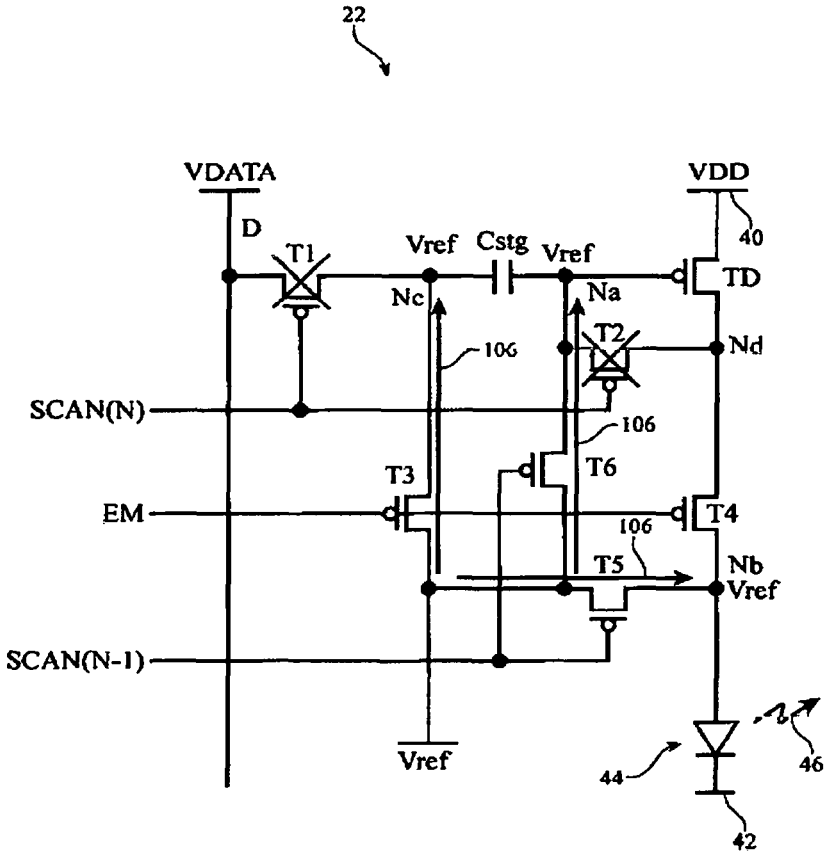
FIG. 15 is a diagram showing current flow in the pixel circuit of FIG. 3 using a timing scheme of the type shown in FIG. 14 during initialization operations in accordance with an embodiment.

Operation of pixel 22 of FIG. 3 during initialization period 78 of FIG. 14 is shown in FIG. 15. As shown by arrows 106 in FIG. 15, transistors T3, T6, and T5 are on, so voltage Vref is placed on nodes Nc, Na, and Nb.

Figure 16:
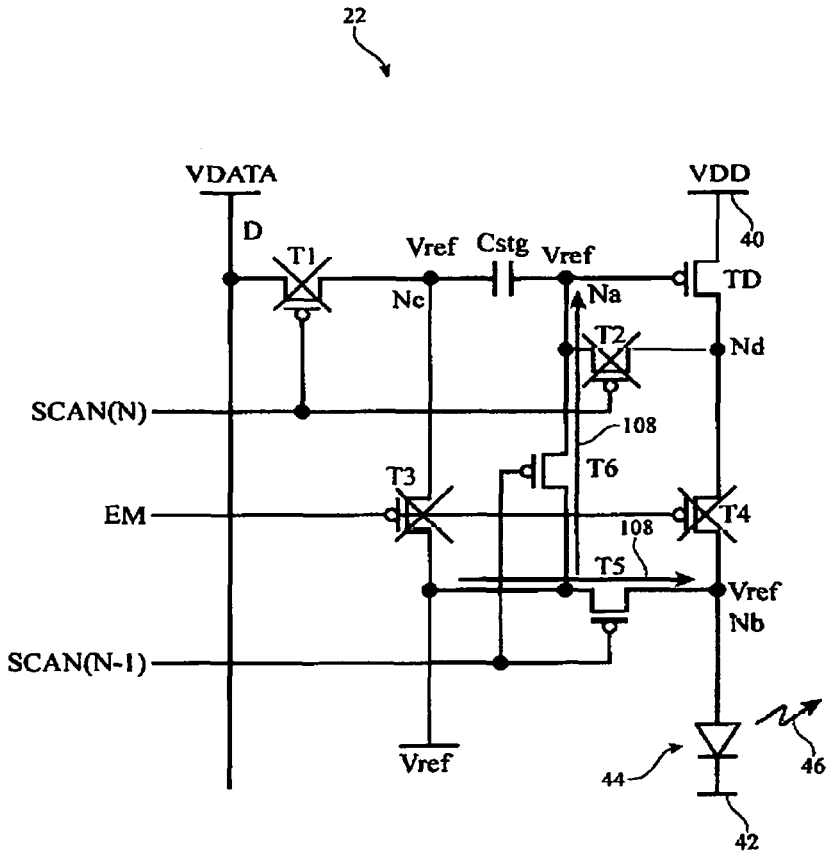
FIG. 16 is a diagram showing current flow in the pixel circuit of FIG. 3 using a timing scheme of the type shown in FIG. 14 during on-bias stress operations in accordance with an embodiment.

Operation of pixel 22 of FIG. 3 during on-bias stress period 80 of FIG. 14 is shown in FIG. 16. As shown by arrows 108 in FIG. 16, transistors T6 and T5 remain on during period 80, so voltage Vref continues to be maintained on nodes Na and Nb. There is no current flow from Vdd to Vref during initialization period 78 and on-bias stress period 80, so a relatively long on-bias stress may be used to reduce Vth hysteresis effects.

Figure 17:
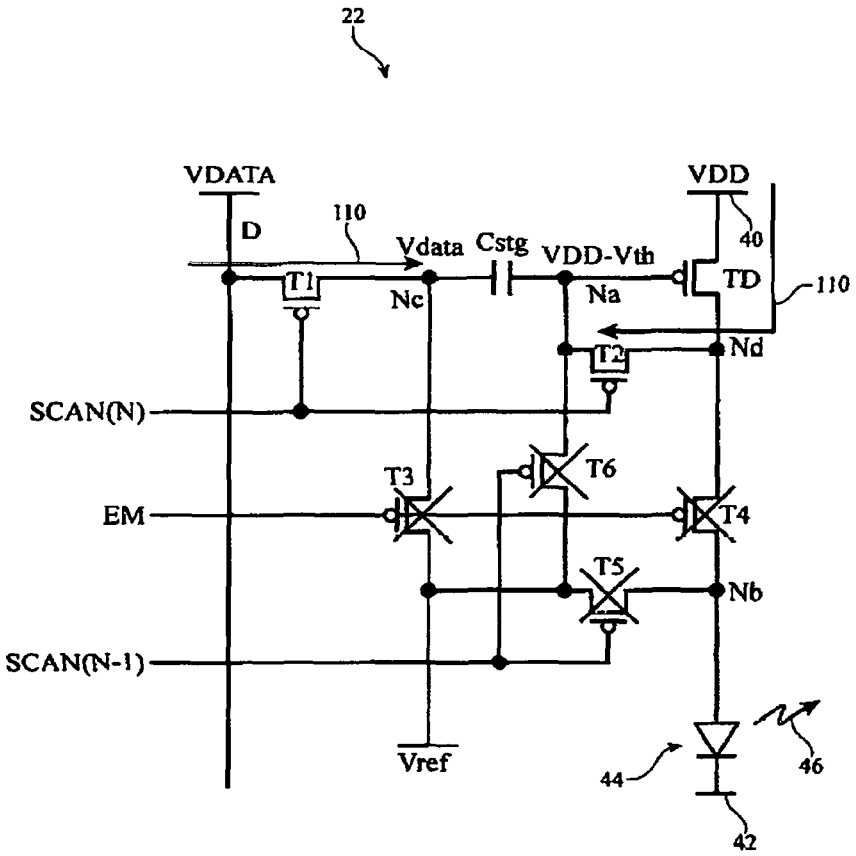
FIG. 17 is a diagram showing current flow in the pixel circuit of FIG. 3 using a timing scheme of the type shown in FIG. 14 during data writing (loading) and threshold voltage sampling operations in accordance with an embodiment.

FIG. 17 is a diagram showing current flow in pixel circuit 22 of FIG. 3 during data writing and threshold voltage sampling period 82 of FIG. 14. As shown by arrows 110, during period 82, data signal Vdata is loaded onto node Nc through transistor T1 and voltage Vdd-Vth is located onto node Na through transistor TD.

Figure 18:
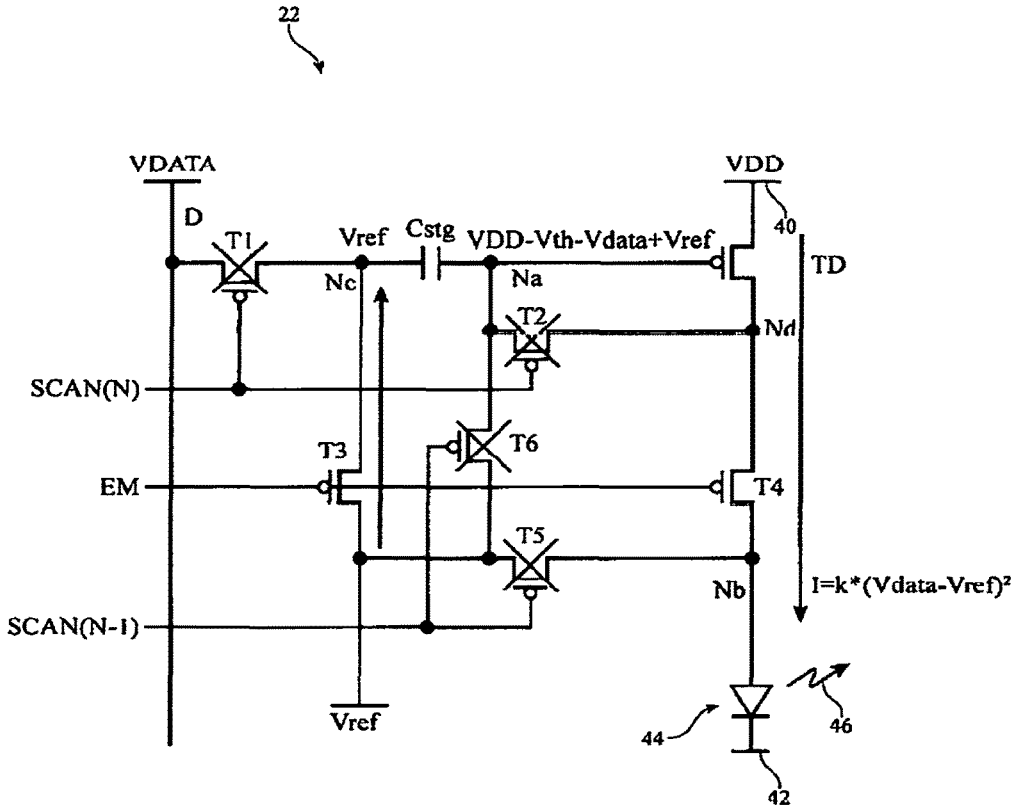
FIG. 18 is a diagram showing current flow in the pixel circuit of FIG. 3 using a timing scheme of the type shown in FIG. 14 during emission operations in accordance with an embodiment.

FIG. 18 is a diagram showing current flow in pixel circuit 22 of FIG. 3 during emission period 84 of FIG. 14. As shown in FIG. 18, current I is independent of threshold voltage Vth.

The foregoing is merely illustrative and various modifications can be made by those skilled in the art without departing from the scope and spirit of the described embodiments. The foregoing embodiments may be implemented individually or in any combination.

What is claimed is:

1. A display, comprising:

display driver circuitry;

data lines coupled to the display driver circuitry;

gate lines coupled to the display driver circuitry; and an array of pixels, wherein the pixels receive data from the display driver circuitry over the data lines and are controlled with control signals received from the display driver circuitry over the gate lines, wherein each pixel in the array of pixels has a light-emitting diode, a drive transistor, and an emission enable transistor coupled in series between first and second power supply terminals and has a first switching transistor coupled to two terminals of the drive transistor, wherein the display driver circuitry is configured to supply the control signals and data to operate the array of pixels in an initialization period that comprises at least first and second on-bias stress periods separated by an intervening period that is different from the first and second on-bias stress periods, a data writing and threshold voltage sampling period, and an emission period, and wherein the display driver circuitry is configured to supply the control signals and data to turn off the emission enable transistor during the first and second on-bias stress periods and the intervening period, to turn on the first switching transistor during the intervening period and the data writing and threshold voltage sampling period, and to turn off the first switching transistor during the first and second on-bias stress periods.

2. The display defined in claim 1, wherein the gate lines include an emission enable control line that is coupled to a gate of the emission enable transistor, and wherein each pixel further comprises an additional emission enable transistor having a gate coupled to the emission enable control line.

3. The display defined in claim 2, wherein each pixel further comprises:

a capacitor; and first, second, and third nodes, wherein the second node is between the emission enable transistor and the light-emitting diode, and wherein the capacitor is coupled between the first and third nodes.

4. The display defined in claim 3, wherein the additional emission enable transistor of each pixel is coupled between a reference voltage terminal and the third node in the pixel.

5. The display defined in claim 4, wherein each pixel further comprises a second switching transistor that is coupled between one of the data lines and the third node.

6. The display defined in claim 5, wherein the drive transistor in each pixel includes a source terminal coupled to the first power supply terminal, includes a drain terminal coupled to the emission enable transistor at a fourth node, and includes a gate terminal, and wherein the first switching transistor is coupled between the first node and the fourth node.

7. The display defined in claim 6, further comprising third and fourth switching transistors in each pixel that are coupled in series between the first node and the second node.

8. The display defined in claim 7, wherein the third switching transistor in each pixel is coupled between the second node and the reference voltage terminal.

9. The display defined in claim 8, wherein the fourth switching transistor is coupled between the first node and the reference voltage terminal.

10. The display defined in claim 9, wherein the first switching transistor and the second switching transistor in each pixel have gates coupled to a first of the gate lines, and wherein the third and fourth switching transistors in each pixel have gates coupled to a second of the gate lines.

11. The display defined in claim 1, wherein each of the pixels has seven transistors including the drive transistor and the emission enable transistor, and wherein each of the pixels has a capacitor.

12. The display defined in claim 11, wherein each of the pixels receives a first of the control signals on a first of the gate lines, a second of the control signals on a second of the gate lines, and a third of the control signals on a third of the gate lines, and wherein the first of the control signals is an emission enable control signal that is applied to the emission enable transistor to turn the emission enable transistor off during the first and second on-bias stress periods and the intervening period and during the data writing and threshold voltage sampling period, and to turn the emission enable transistor on during the emission period.

13. A light-emitting diode display pixel circuit, comprising:

first, second, third, fourth, fifth, sixth, and seventh transistors;

first, second, third, and fourth nodes;

first and second power supply terminals, wherein the seventh transistor has a gate coupled to the first node, a source coupled to the first power supply terminal, and a drain coupled to the fourth node;

a light-emitting diode coupled between the second node and the second power supply terminal, wherein the fourth transistor is coupled between the second node and the fourth node;

a data line that supplies data to the third node through the first transistor;

a reference voltage terminal that is coupled to the third node through the third transistor; and a control signal line that supplies a control signal to the first transistor to turn off the first transistor during a plurality of pulses in an initialization period, wherein first and second pulses in the plurality of pulses are separated by a period during which the first transistor is turned on and wherein the data line supplies the data during a data loading period after the initialization period.

14. The light-emitting diode display pixel circuit defined in claim 13, further comprising a capacitor coupled between the first and third nodes.

15. The light-emitting diode display pixel circuit defined in claim 14, wherein the second transistor is coupled between the first and fourth nodes.

16. The light-emitting diode display pixel circuit defined in claim 15, wherein the fifth transistor is coupled between the reference voltage terminal and the second node.

17. The light-emitting diode display pixel circuit defined in claim 16, wherein the sixth transistor is coupled between the reference voltage terminal and the first node.

18. The light-emitting diode display pixel circuit defined in claim 13, wherein during the period during which the first transistor is turned on, the fourth transistor is turned off.

19. The light-emitting diode display pixel circuit defined in claim 18, wherein the sixth and seventh transistors are coupled between the first and second nodes, and wherein during the period during which the first transistor is turned on, the sixth transistor is turned off.

20. An organic light-emitting diode display pixel circuit, comprising:

first, second, third, fourth, fifth, sixth, and seventh transistors;

first, second, third, and fourth nodes;

first and second power supply terminals, wherein the seventh transistor has a gate coupled to the first node, a source coupled to the first power supply terminal, and a drain coupled to a fourth node;

an organic light-emitting diode coupled between the second node and the second power supply terminal, wherein the fourth transistor is coupled between the second node and the fourth node;

a capacitor coupled between the first and third nodes, wherein the second transistor is coupled between the first and fourth nodes, wherein the fifth transistor is coupled between the second node and a reference voltage terminal, and wherein the sixth transistor is coupled between the first node and the reference voltage terminal; and a gate line that supplies a control signal to the second transistor to turn off the second transistor during first and second pulses in an initialization period, wherein the first pulse is separated from the second pulse by a period during which the second transistor is turned on and wherein a data line supplies data to the third node during a data loading period after the initialization period.

21. The organic light-emitting diode display pixel circuit defined in claim 20, wherein the third transistor is coupled between the third node and the reference voltage terminal.

22. The organic light-emitting diode display pixel circuit defined in claim 21, wherein the fourth transistor receives an additional control signal from an additional gate line that is different from the control signal.

23. The organic light-emitting diode display pixel circuit defined in claim 20, wherein during the period during which the second transistor is turned on, the fifth and sixth transistors are turned off.

* * * * *